US006010539A

United States Patent [19]

Del Pesco

[11] Patent Number: 6,010,539

[45] **Date of Patent: *Jan. 4, 2000**

[54] CLEANING FORMULATIONS FOR TEXTILE FABRICS

[75] Inventor: Thomas Wayne Del Pesco, Hockessin, Del.

[73] Assignee: E. I. Du Pont de Nemours and Company, Wilmington, Del.

[ * ] Notice: This patent is subject to a terminal disclaimer.

[21] Appl. No.: 08/944,216

[22] Filed: Oct. 6, 1997

Related U.S. Application Data

[63] Continuation-in-part of application No. 08/720,932, Oct. 4, 1996, abandoned, which is a continuation-in-part of application No. 08/626,080, Apr. 1, 1996, abandoned.

[51] Int. Cl.[7] ..... C11D 3/075; C11D 3/24

[52] U.S. Cl. ..... 8/137; 510/280; 510/299; 510/423; 510/424; 510/528

[58] Field of Search ..... 510/280, 299, 510/423, 424, 528; 134/42; 8/137

[56] References Cited

U.S. PATENT DOCUMENTS

| | | | |
|---|---|---|---|
| 3,206,408 | 9/1965 | Vitalis et al. | 252/161 |
| 3,488,311 | 1/1970 | Burdick et al. | 260/29.6 |
| 3,630,919 | 12/1971 | Sheaffer et al. | 252/88 |
| 3,639,290 | 2/1972 | Fearnley et al. | 252/545 |
| 3,716,488 | 2/1973 | Kolsky et al. | 252/155 |
| 3,779,929 | 12/1973 | Abler et al. | 252/90 |
| 3,835,071 | 9/1974 | Allen et al. | 252/545 |
| 3,901,727 | 8/1975 | Loudas | 134/4 |
| 3,948,819 | 4/1976 | Wilde | 252/545 |
| 4,035,148 | 7/1977 | Metzger et al. | 8/137 |
| 4,043,923 | 8/1977 | Loudas | 252/8.75 |
| 4,043,964 | 8/1977 | Sherman et al. | 260/29.6 |
| 4,090,967 | 5/1978 | Falk | 252/3 |
| 4,090,974 | 5/1978 | Morganson | 252/135 |
| 4,145,303 | 3/1979 | Loudas | 252/156 |
| 4,160,777 | 7/1979 | Loudas | 260/456 |
| 4,203,859 | 5/1980 | Kirn et al. | 252/174.23 |
| 4,219,333 | 8/1980 | Harris | 510/280 X |
| 4,279,796 | 7/1981 | Tarkinson | 260/29.6 |
| 4,302,348 | 11/1981 | Requejo | 510/424 X |
| 4,348,292 | 9/1982 | Ginn | 510/423 X |
| 4,419,298 | 12/1983 | Falk et al. | 260/501.16 |
| 4,438,016 | 3/1984 | Kiewert et al. | 252/174.25 |
| 4,493,781 | 1/1985 | Chapman et al. | 252/88 |
| 4,526,583 | 7/1985 | Gioffre | 8/137 |
| 4,536,254 | 8/1985 | Falk et al. | 162/135 |
| 4,564,463 | 1/1986 | Secemski et al. | 510/299 |
| 4,566,980 | 1/1986 | Smith | 252/8.6 |
| 4,581,385 | 4/1986 | Smith et al. | 521/111 |
| 4,661,170 | 4/1987 | Osberghaus et al. | 148/6.27 |
| 4,678,595 | 7/1987 | Malik et al. | 252/174.17 |
| 4,873,000 | 10/1989 | Weller | 252/8.6 |
| 4,925,707 | 5/1990 | Vinod | 427/393.4 |
| 5,073,442 | 12/1991 | Knowlton et al. | 428/267 |
| 5,209,857 | 5/1993 | Kenyon et al. | 252/8.6 |
| 5,212,272 | 5/1993 | Sargent et al. | 526/317.1 |
| 5,330,672 | 7/1994 | Langer et al. | 510/299 |
| 5,338,475 | 8/1994 | Corey et al. | 252/102 |
| 5,514,302 | 5/1996 | Brown | 252/545 |
| 5,534,167 | 7/1996 | Billman | 510/280 |
| 5,712,240 | 1/1998 | Tyerech et al. | 510/423 X |

FOREIGN PATENT DOCUMENTS

| | | | |
|---|---|---|---|
| 985113 | 3/1976 | Canada | 134/3 |
| 1323819 | 11/1993 | Canada | C11D 9/02 |
| 0 648 834 A1 | 4/1995 | European Pat. Off. | C11D 1/83 |
| 2710306 | 9/1978 | Germany | C11D 3/43 |
| 56-129281 | 10/1981 | Japan . | |
| 6900307 | 10/1969 | Netherlands | C11D 7/22 |
| 1 486 619 | 9/1977 | United Kingdom . | |
| WO 94/07980 | 4/1994 | WIPO . | |
| WO 95/34631 | 12/1995 | WIPO | C11D 3/39 |
| WO 96/11247 | 4/1996 | WIPO | C10M 173/00 |

*Primary Examiner*—Richard D. Lovering

[57] ABSTRACT

This invention relates to aqueous cleaning formulations particularly useful in the hot water extraction cleaning of textile fabrics such as rugs, carpets and upholstery. The cleaning formulations are essentially free of organic solvents and comprise 0.1 to 50 grams of an inorganic or organic builder per gallon of cleaning formulation, 0.1 to 100 grams of a mixed alkyl ethoxylate ($C_{10}$–$C_{16}$) nonionic surfactant, with a hydrophile-lipophile balance value in the range of 10.5 to 15, per gallon of cleaning formulation, and 0.1 to 100 grams of a fluorosurfactant per gallon of cleaning formulation.

18 Claims, 1 Drawing Sheet

CLEANING FORMULATIONS FOR TEXTILE FABRICS

CROSS-REFERENCE TO RELATED APPLICATION

This application is a continuation-in-part of application Ser. No. 08/720,932, filed Oct. 4, 1996 (RD-7145-A), now abandoned which is itself a continuation-in-part of application Ser. No. 08/626,080, filed Apr. 1, 1996 (RD-7145), now abandoned.

FIELD OF THE INVENTION

This invention relates to aqueous cleaning formulations particularly useful in the hot water extraction cleaning of textile fabrics such as rugs, carpets and upholstery.

BACKGROUND OF THE INVENTION

Hot water extraction is currently a preferred method for cleaning textile fabrics such as rugs, carpets and upholstery. In such a method, hot, aqueous cleaning solution is sprayed onto the fabric to be cleaned, e.g., a carpet, and then rapidly removed by vacuum. Typically, application is by a wand which contains both a sprayer and vacuum head. Under optimum conditions, one pass of the wand would restore a dirty carpet to its original cleanliness. However, in practice it takes many passes of the wand to restore a carpet to a condition approaching its original cleanliness.

The literature contains many cleaning formulations suitable for use in hot water extraction cleaning systems. It would be advantageous if a cleaning formulation could be developed which would reduce the number of times that the wand must be passed over the carpet in order to obtain a satisfactorily cleaned carpet. Such a cleaning formulation would have environmental benefits, since less water and cleaning ingredients would be needed to clean the carpet. A further advantage would be if the residue from a cleaning formulation left on a carpet did not attract dirt and food additives. The present invention provides such cleaning formulations.

SUMMARY OF THE INVENTION

This invention provides aqueous cleaning formulations, essentially free of organic solvents, comprising 0.1 to 50 grams of an inorganic or organic builder per gallon of cleaning formulation, 0.1 to 100 grams of a mixed alkyl ethoxylate ($C_{10}$–$C_{16}$) nonionic surfactant, with a hydrophile-lipophile balance (HLB) value in the range of 10.5 to 15, per gallon of cleaning formulation, and 0.1 to 100 grams of a fluorosurfactant per gallon of cleaning formulation.

In addition, the aqueous cleaning formulation may contain 1.0 to 500 grams of soil-resist agent per gallon of cleaning formulation and/or 1.0 to 500 grams of stain-resist agent per gallon of cleaning formulation. Suitable soil-resist agents include, for example, polymeric fluorochemicals and poly(methyl methacrylate). Suitable stain-resist agents include those selected from the group consisting of a polymer of hydrolyzed maleic anhydride with an aliphatic alpha olefin, an aromatic olefin, or vinyl ether and a polymer of methacrylic acid.

The builder in the cleaning formulation may be an inorganic builder selected from the group consisting of sodium tripolyphosphate, sodium sesquicarbonate and mixtures thereof, as well as other materials normally considered as builders in cleaning formulations, such as ethylenediaminetetraacetic acid (EDTA). The fluorosurfactant in the cleaning formulation may comprise any anionic or nonionic compound or mixture of compounds such as, for example, the compounds of Formula I and Formula II, where Formula I is:

$$F(CF_2)n—CH_2CH_2—S—CH_2CH_2—COOLi \quad \text{I}$$

wherein n is an integer having a value of 6 to 12; and where Formula II is:

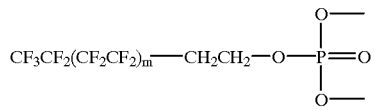

$$CF_3CF_2(CF_2CF_2)_m—CH_2CH_2—O—P(=O)(O—)(O—) \quad \text{II}$$

wherein m is an integer having a value of 2 to 5.

The cleaning formulation of this invention is essentially free of organic solvents, such as alcohols and glycols. It has been found that the absence of such organic solvents is a key factor in achieving resoiling performance that is better than that attained using cleaning formulations containing organic solvents. Cleaning formulations that are essentially free of organic solvents are also preferred because they do not contain volatile organic compounds which pose environmental and health risks in use.

One example of the cleaning formulation of this invention comprises sodium tripolyphosphate as the inorganic builder, a mixed alkyl ethoxylate ($C_{10}$–$C_{16}$) having a hydrophile-lipophile balance value of 12.8 as the nonionic surfactant, and the above-described mixture of fluorosurfactant compounds. In such a formulation, the concentration of sodium tripolyphosphate may be about 1 to 30 grams/gallon of formulation, the concentration of mixed alkyl ethoxylate nonionic surfactant may be about 1 to 30 grams/gallon of formulation, and the concentration of fluorosurfactant may be about 1 to 20 grams/gallon of formulation.

This invention also includes cleaning concentrates suitable for making the aqueous cleaning formulations of this invention. The cleaning concentrate comprises: (a) an inorganic or organic builder, (b) a mixed alkyl ethoxylate ($C_{10}$–$C_{16}$) nonionic surfactant with a hydrophile-lipophile balance value in the range of 10.5 to 15, and (c) a fluorosurfactant, whereby the concentrate is capable of being diluted with an appropriate amount of water to produce an aqueous cleaning formulation having a concentration of 0.1 to 50 grams of inorganic or organic builder per gallon of cleaning formulation, 0.1 to 100 grams of mixed alkyl ethoxylate ($C_{10}$–$C_{16}$) nonionic surfactant, preferably 0.1 to 50 grams, with a hydrophile-lipophile balance value in the range of 10.5 to 15, per gallon of cleaning formulation, and 0.1 to 100 grams of fluorosurfactant per gallon of cleaning formulation. The cleaning concentrate may further comprise a soil-resist agent and/or a stain-resist agent. These concentrates are capable of being used to make aqueous cleaning formulations having 1.0 to 500 grams of soil-resist agent and/or stain-resist agent per gallon of cleaning formulation.

This invention also provides a method of using the above-described aqueous cleaning formulations to clean a textile fabric, such as rugs, carpets, and upholstery, having soil on its surface comprising the steps of spraying the formulation having a temperature in the range of room temperature to 160° F. onto the surface of the textile fabric such that at least some of the soil on the surface is loosened; and removing the loosened soil. The loosened soil may be removed by vacuum or other suitable means.

DETAILED DESCRIPTION OF THE INVENTION

Figure 1:
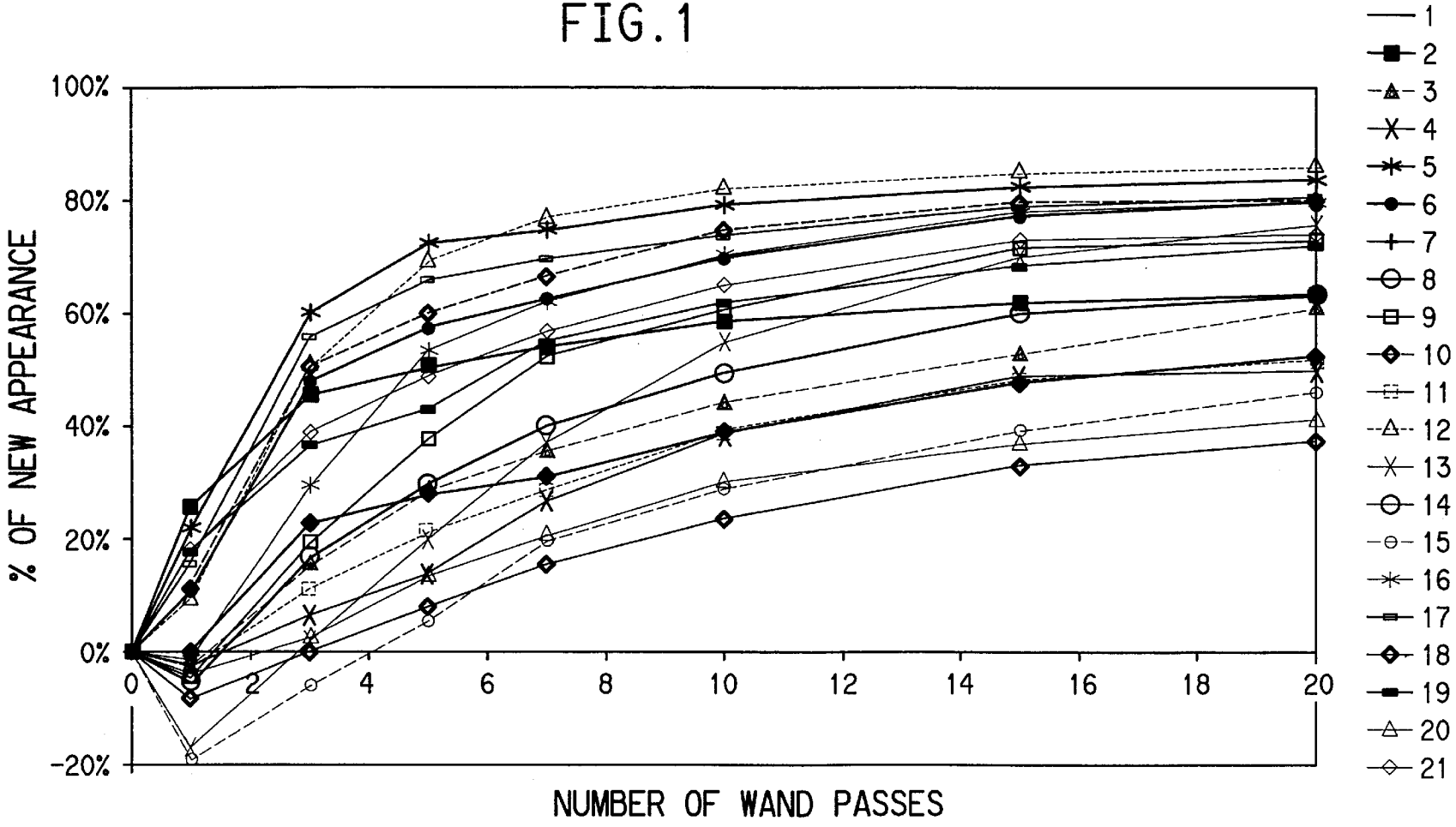
FIG. 1 is a graph showing the percent changes in ΔE versus the number of wand passes with Control Sample Cleaning Formulations 1–21 as reported in Table I.

This invention provides an aqueous cleaning formulation which, when used in a hot water extraction cleaning process, improves the cleaning rate of the process (i.e. reduces the number of times the extraction wand must be run over the same area of the textile fabric to be cleaned in order to achieve the desired degree of cleanliness). This invention also relates to a method of using the cleaning formulation to clean textile fabrics.

In the method of this invention, the selected cleaning formulation having a temperature in the range of room temperature to 160° F. is sprayed onto the surface of the textile fabric in such a manner that at least some of the soil on the fabric's surface is loosened, and this loosened soil is then removed. Some of the loosened soil may be dispersed in the formulation. Suitable means for removing the loosened soil include vacuuming.

The aqueous cleaning formulations of this invention are essentially free of organic solvents and comprise (a) an inorganic or organic builder; (b) a mixed alkyl ethoxylate ($C_{10}$–$C_{16}$) nonionic surfactant with an HLB (hydrophile-lipophile balance) value in the range of 10.5 to 15, preferably 10.5 to 13, for example "Merpol" SH, (available from DuPont Co., Wilmington, Del.) and (c) a fluorosurfactant.

Suitable inorganic builders include, for example, sodium tripolyphosphate, sodium sesquicarbonate, and mixtures thereof. Suitable organic builders include, for example, ethylenediaminetetraacetic acid (EDTA). By the term "builder", it is meant a chemical which softens water by chelating metal ions. Mixtures of inorganic and organic builders can also be used. By the term, "mixed alkyl ethoxylate ($C_{10}$–$C_{16}$)" it is meant a mixture of alkyl ethoxylate compounds having a carbon chain length in the range of $C_{10}$to $C_{16}$. Suitable fluorosurfactants include but not limited to, for example, those compounds commercially available from DuPont, 3M. Mixtures of fluorosurfactants may also be used. A suitable mixture of fluorosurfactants is that of the compounds of Formula I and Formula II, where Formula I is:

$$F(CF_2)_n—CH_2CH_2—S—CH_2CH_2—COOLi \quad \text{I}$$

wherein n is an integer having a value of 6 to 12 and may be identified as an α-{2-[(2-carboxyethyl)thio]ethyl}-ω-fluoro-poly-(difluoromethylene) lithium salt, and wherein Formula II is an amine salt of a perfluoroalkyl phosphate as represented by the general formula:

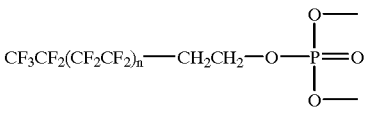

II wherein n is an integer having a value of 6 to 12. The weight ratio of Formula I to the perfluoroalkyl phosphate of Formula II in the mixture is in the range of from bout 1:1 to about 1:2. The compound of Formula I is available from DuPont as "Zonyl" FSA and the compound of Formula II is available from DuPont as "Zonyl" FSP.

Other suitable fluorosurfactants include the compounds of Formula III and IV, wherein Formula III is:

$$F(CF_2CF_2)_n—CH_2CH_2—O—(CH_2CH_2)_y—OH \quad \text{III}$$

wherein n is an integer having a value of 6 to 12. and wherein Formula IV is:

$$F(CF_2CF_2)_n—CH_2CH_2—O—(CH_2CH_2)_x—OH \quad \text{IV}$$

wherein n is an integer having a value of 6 to 12, y is an integer having a value of less than 20, and x is an integer having a value of less than y.

The compound of Formula III is available from DuPont as "Zonyl" FSN and the compound of Formula IV is available from DuPont as "Zonyl" FSO. Fluorosurfactants available from 3M may also be used including "Florad" products designated as FC-93, FC-100, FC-120, FC-129, and FC-117.

As will be demonstrated in the Examples hereinafter, the choice of nonionic surfactant is critical to the efficacy of the cleaning formulation. Nonionic surfactants having HLB values outside of the range of 10.5 to 15 either do not clean as well as those having HLB values within that range or their residue left on the carpet attracts dirt (increases resoiling) more than nonionic surfactants having HLB values within that range.

Depending on the actual builder, nonionic surfactant, and fluorosurfactant used in the cleaning formulation, the useful concentrations of each ingredient will vary. Generally, the concentration of the inorganic or organic builder should be in the range of 0.1 to 50 grams per gallon of cleaning formulation, the concentration of the mixed alkyl ethoxylate ($C_{10}$–$C_{16}$) nonionic surfactant with a HLB value in the range of 10.5 to 15 should be in the range of 0.1 to 100 grams per gallon of cleaning formulation, and the concentration of fluorosurfactant should be in the range of 0.1 to 100 grams per gallon of cleaning formulation.

Optionally, the cleaning formulation may contain a polymeric chemical, usually a polymer containing fluorine such as commercial products made by DuPont, 3M, etc., in order to reduce resoiling and may also optionally contain a stain-resist agent, preferably a styrene maleic anhydride, in order to reduce restaining. By "resoiling" it is meant the tendency of a cleaned carpet to attract dirt because of cleaning formulation left on the carpet after cleaning. Similarly, by "restaining" it is meant the tendency of a cleaned carpet to attract stains which may be caused in part because of cleaning formulation left on the carpet after cleaning.

One preferred embodiment of the cleaning formulation of this invention contains 0.5 to 50 g/gal. of sodium tripolyphosphate builder, 0.1 to 50 g/gal. of sodium sesquicarbonate builder, 1 to 50 g/gal. of Merpol SH, and 0.5 to 100 g/gal. of a fluorosurfactant mixture of the above Formula I compound and Formula II compound. More preferably, the concentration of sodium tripolyphosphate is about 1 to 30 g/gal., sodium sesquicarbonate is about 0.5 g/gal., "Merpol" SH is about 1 to 30 g/gal., and fluorosurfactant is about 1 to 20 g/gal. All concentrations are based on a gallon of the cleaning formulation, unless otherwise indicated.

If enhanced resistance to resoiling is required, 1 to 500 g/gal. soil resist agent may be added to the basic formulations described above. By "soil resist agent" it is meant compositions which resist or repel dirt, oil, or other substances not normally intended to be present on the textile fabric. Suitable soil-resist agents include polymeric fluorochemicals and poly (methyl methacrylate). Fluorochemical soil resist agents may include polymers or compounds having pendent or end groups of perfluoroalkyl moieties, fluorosurfactants, or fluorointermediates. Examples of some suitable fluorochemical soil resist agents include "Zonyl" 5180, available from DuPont and "Scotchgard" available from 3M. "Zonyl" 5180 works very well at a concentration of about 50–250 g/gal. Depending on the desired end-use of the aqueous cleaning formulation, the amount of soil-resist agent and other ingredients should be adjusted. If the primary use of the cleaning formulation is to improve cleaning efficiency, less soil-resist agent should be added to the formulation. If the primary use of the cleaning formulation is to improve resoiling performance, more soil-resist agent should be added to the formulation.

If resistance to restaining is required, 1 to 500 g/gal. of a stain-resist agent may be added to any of the above formulations. By "stain-resist agent" it is meant chemicals which impart partial or total resistance to staining. Staining is defined as discoloration due to a material (such as food or liquid) adding color that exhibits resistance to removal by standard cleaning methods. Stain resist agents may include compounds such as hydrolyzed maleic anhydride co- or terpolymers with aliphatic alpha olefins, aromatic olefins or vinyl ethers, and homo- or copolymers of methacrylic acid. Preferably the stain resist agent is "Zelan" 338 which is available from the DuPont. "Zelan" 338 works very well at about 50–250 g/gal. Depending on the desired end-use of the aqueous cleaning formulation, the amount of stain-resist agent and other ingredients should be adjusted. If the primary use of the cleaning formulation is to improve cleaning efficiency, less stain-resist agent should be added to the formulation. If the primary use of the cleaning formulation is to improve restaining performance, more stain-resist agent should be added to the formulation.

Other chemical agents, such as fragrances, softeners, buffers, and brighteners may be added to the cleaning formulation to obtain special effects on the cleaned carpet fiber.

The cleaning formulation of this invention is essentially free of organic solvents, such as alcohols and glycols. It has been found that the absence of such organic solvents is a key factor in achieving resoiling performance that is better than that attained using cleaning formulations containing organic solvents. Cleaning formulations that are essentially free of organic solvents are also preferred because they do not contain volatile organic compounds which pose environmental and health risks in use. The scope of the invention encompasses cleaning formulations containing trace amounts of organic solvents. By "trace amounts" is meant less than one percent by weight.

As described above, the aqueous cleaning formulations of this invention refer to the formulations as they are applied to textile fabrics such as carpets. It is recognized that cleaning concentrates suitable for making the aqueous cleaning formulations of this invention by dilution with water can also be made. These cleaning concentrates would then be provided to the carpet cleaner or other end-user. The present invention also encompasses such cleaning concentrates. The cleaning concentrate is essentially free of organic solvents and comprises: (a) an inorganic or organic builder, (b) a mixed alkyl ethoxylate ($C_{10}$–$C_{16}$) nonionic surfactant with a hydrophile-lipophile balance value in the range of 10.5 to 15, and (c) a fluorosurfactant, whereby the concentrate is capable of being diluted with an appropriate amount of water to produce an aqueous cleaning formulation having a concentration of 0.1 to 50 grams of inorganic or organic builder per gallon of cleaning formulation, 0.1 to 100 grams of mixed alkyl ethoxylate ($C_{10}$–$C_{16}$) nonionic surfactant with a hydrophile-lipophile balance value in the range of 10.5 to 15, per gallon of cleaning formulation, and 0.1 to 100 grams of fluorosurfactant per gallon of cleaning formulation. The cleaning concentrate may further comprise a soil-resist agent and/or a stain-resist agent. These concentrates may be used to make aqueous cleaning formulations having 1.0 to 500 grams of soil-resist agent and/or stain-resist agent per gallon of cleaning formulation.

The following Examples are illustrative of this invention but should not be construed as limiting the scope of this invention.

TEST METHODS

Cleaning Efficiency—Cleaning efficiency refers to both the cleaning rate and cleaning ceiling which are determined by these test procedures. Cleaning rate is a measure of how many times a hot water extraction wand has to be run over the same area of a soiled carpet before a desired degree of cleanliness is achieved. Cleaning ceiling is a measure of the efficacy of a cleaning formulation towards returning a soiled carpet to its original, unsoiled condition by repeated cleanings with the hot water extraction wand.

The equipment used was a standard hot water extractor (Stallion Walk Behind Unit Model No. 8SC) equipped with an in-line heater and 3.5 inch upholstery cleaning head with 1 jet. A Minolta CR-100 Chroma Meter was used to measure ΔE of the carpets before cleaning and intermittently throughout the cleaning process. ΔE is a measure of cleanliness since dirty carpets appear dark and they lighten on cleaning.

In preparation for cleaning the carpet with the cleaning formulation, the formulation to be tested was loaded in the extractor, the line was flushed, and the carpet was vacuumed prior to application of the formulation. The cleaning procedure involved the following steps.

(a) The spray and vacuum head (wand) was run on the designated test area of the carpet to be cleaned at a steady linear motion of about 2 sec./foot. This was followed immediately with a vacuum cycle only; the area cleaned was about 8–10 inches by 3.5 inches.

(b) The change in appearance ΔE was measured and recorded.

(c) After one minute, step (a) was repeated twice and ΔE measured again.

Step (c) was repeated as many times as necessary, until the measured ΔE no longer changed significantly (usually 2–3 sets). These ΔE measurements were made at different places within the test area of the carpet. The average value of the ΔE measurements from the different places within the test area of the carpet was reported.

Cleaning rate is determined by the change in the ΔE with each wand or pair of wand passes (cleaning treatments). However since the carpet has been soiled by actual people walking on the carpet, some areas of the carpet are more soiled than others and there is a variation in the degree of soiling in any selected test area of carpet. In order to compensate for variations in the ΔE of the soiled, uncleaned carpet, the change in ΔE with each wand pass was divided by the ΔE of the initial soiled test area of the carpet which was subjected to the wand pass. This cleaning rate for each wand pass may be expressed as a percentage change in ΔE per the following equation:

$$(\Delta E \text{ of soiled carpet})-(\Delta E \text{ of carpet after wand pass})/(\Delta E \text{ of soiled carpet})\times 100$$

The percentage change in ΔE is tantamount to measuring the cleaning percentage of the carpet with 100% representing the appearance of new, clean carpet and 0% representing soiled, uncleaned carpet. New, clean carpet was available and was used as the standard (target) in the Minolta measurements and for determining the efficacy, (as a percentage change in ΔE) of the cleaning formulation toward returning the soiled carpet to its original condition. The standard value of the new clean carpet was first measured by the Minolta Chroma Meter and this value was then stored in the memory of the Minolta Chroma Meter. The value of the soiled carpet was then measured by the Minolta Chroma Meter, and the ΔE was calculated therefrom.

Resoiling Test—The ability of a cleaned carpet to resist resoiling was determined by an accelerated soiling test wherein a cleaned carpet was exposed to a controlled amount of soil for a specified time, vacuumed to remove loose soil and the ΔE measured. As in the Cleaning Efficiency Test, new, clean carpet was used as the standard (target) in the Minolta measurements. The standard value for the new, clean carpet was first measured and the ΔE of the resoiled carpet was calculated therefrom.

In addition to the Minolta Chroma Meter, the equipment used in this Resoiling Test included a ball mill having a drum 10.5 inches deep, 40 inches in circumference and dirty polymer pellets (used to introduce a controlled amount of soil). The dirty polymer pellets were prepared by adding 3g of synthetic soil to 1000 g of nylon polymer pellets and mixing in the ball mill for 10 minutes at 30 rpm. The synthetic soil was prepared according to AATCC Test Method 123-1989 and contained (percentages are by weight): 38% dark peat moss, 17% portland cement, 17% kaolin clay, 17% silica (200 mesh), 1.75% carbon black (furnace or lamp black), 0.5% red iron oxide and 8.75% mineral oil (medicinal grade).

Carpets were soiled by mounting them in the clean drum, double taping at the seams. 500 g of soiled polymer pellets were then added along with cylindrical grinding stones (12×67.5 g stones and 200 4.5 g stones). The mill was run at 30 rpm for 30 minutes. Carpets were removed, vacuumed with a vacuum cleaner not having a beater bar to remove loose dirt, and the ΔE was measured.

EXAMPLES

Control Samples 1–21

In order to illustrate the improvement in cleaning efficiency obtained by using the cleaning formulations of this invention, control cleaning formulations of 21 commercially available cleaners were first used to clean a soiled test carpet. The above-described hot water extraction method was used to clean the carpets, and the cleaning efficiency was determined per the above-described Test Methods. The carpet used was a nylon carpet made from DuPont "Antron" Legacy nylon 6,6 fibers. The color of the nylon carpet was a light beige and was installed in a busy commercial setting where it was subjected to heavy traffic daily.

The data showing the percentage changes in ΔE data are contained in Table I and shown graphically in FIG. 1.

TABLE I

CLEANING EFFICIENCY
(Percent Change In Δ E Measured For 0 To 20 Wand Passes)

| Control Cleaning Formulation | No. of Wand Passes 0 | 1 | 3 | 5 | 7 | 10 | 15 | 20 |
|---|---|---|---|---|---|---|---|---|
| 1 | 0% | 0% | 24% | 29% | 33% | 39% | 47% | 51% |
| 2 | 0% | 26% | 46% | 51% | 54% | 58% | 62% | 66% |

TABLE I-continued

CLEANING EFFICIENCY
(Percent Change In Δ E Measured For 0 To 20 Wand Passes)

| Control Cleaning Formulation | No. of Wand Passes 0 | 1 | 3 | 5 | 7 | 10 | 15 | 20 |
|---|---|---|---|---|---|---|---|---|
| 3 | 0% | −3% | 15% | 29% | 37% | 45% | 54% | 62% |
| 4 | 0% | −6% | 6% | 15% | 27% | 39% | 49% | 55% |
| 5 | 0% | 22% | 60% | 71% | 74% | 78% | 82% | 84% |
| 6 | 0% | 13% | 45% | 57% | 63% | 70% | 76% | 79% |
| 7 | 0% | −8% | 7% | 20% | 29% | 38% | 48% | 55% |
| 8 | 0% | −5% | 16% | 30% | 40% | 50% | 60% | 66% |
| 9 | 0% | −6% | 19% | 37% | 51% | 61% | 71% | 73% |
| 10 | 0% | 13% | 48% | 60% | 67% | 75% | 79% | 80% |
| 11 | 0% | −4% | 12% | 23% | 31% | 39% | 48% | 55% |
| 12 | 0% | 11% | 49% | 69% | 76% | 81% | 84% | 85% |
| 13 | 0% | −16% | 3% | 20% | 37% | 55% | 69% | 77% |
| 14 | 0% | −3% | 9% | 20% | 28% | 37% | 48% | 55% |
| 15 | 0% | −19% | −5% | 6% | 21% | 28% | 39% | 46% |
| 16 | 0% | −6% | 29% | 53% | 63% | 71% | 77% | 79% |
| 17 | 0% | 17% | 55% | 66% | 69% | 73% | 78% | 80% |
| 18 | 0% | −9% | 0% | 9% | 14% | 22% | 31% | 36% |
| 19 | 0% | 15% | 36% | 45% | 56% | 61% | 67% | 74% |
| 20 | 0% | −5% | 3% | 14% | 21% | 30% | 35% | 41% |
| 21 | 0% | 17% | 39% | 49% | 58% | 64% | 72% | 74% |

From FIG. 1, it can be seen that some commercial cleaning formulations actually make the carpet look dirtier (negative percent change in ΔE) before making it look cleaner (positive percent change in ΔE). After seven passes of the wand cleaning head, there is a large difference in carpet cleaning level (62% change in ΔE) between the commercially available cleaners. The commercial cleaners (Samples Nos. 5 and 12) which had good cleaning rates (positive percent changes in ΔE of at least 10% after 1 wand pass), and the best cleaning ceiling (largest positive percent changes in ΔE after 20 wand passes) were used as controls in the following Examples.

EXAMPLE 1

This Example illustrates the criticality of the particular nonionic surfactant used in the cleaning formulations of this invention. Four different nonionic surfactants were tested in similar cleaning compositions. The four nonionic surfactants were "Merpol" SE (HLB=10.5), "Merpol" SH (HLB=12.8), "Merpol" LFH (HLB=10), and "Merpol" HCS (HLB=15.3). The Cleaning Efficiency of the different formulations was measured on a soiled nylon 6 carpet composed of nylon 6 fibers having trilobal cross-sections per the Test Methods described above.

TABLE II

CLEANING EFFICIENCY
(Percent Change In Δ E Measured For 0 TO 5 Wand Passes)

| CLEANING FORMULATION STPP* gms/gal | Nonionic Surfactant | gms/gal nonionic Surfactant | NO. OF WAND PASSES 0 | 1 | 3 | 5 |
|---|---|---|---|---|---|---|
| 10 | "Merpol" SE | 5 | 0 | −12% | 36% | 53% |
| 10 | "Merpol" SH | 10 | 0 | 14% | 53% | 63% |
| 10 | "Merpol" LFH | 10 | 0 | 4% | 42% | 55% |
| 10 | "Merpol" HCS | 10 | 0 | 6% | 49% | 60% |
| 0** | "Merpol" SH | 10 | 0 | −13% | 17% | 34% |

TABLE II-continued

CLEANING EFFICIENCY
(Percent Change In Δ E Measured For 0 TO 5 Wand Passes)

| CLEANING FORMULATION | | | NO. OF WAND PASSES | | | |
|---|---|---|---|---|---|---|
| STPP* gms/gal | Nonionic Surfactant | gms/gal nonionic Surfactant | 0 | 1 | 3 | 5 |

*The first four cleaning formulations contained 0.5 grams/gallon of sodium sesquicarbonate builder.
STPP = sodium tripolyphosphate.
**This cleaning formulation did not contain any STPP or sodium sesquicarbonate builder. Instead, this cleaning formulation contained 5 grams of "Zonyl" 7950 fluorosurfactant per gallon of formulation.

TABLE III

RESOILING PERFORMANCE OF CLEANING FORMULATIONS
(Concentration of Ingredient in Grams Per Gallon of Cleaning Formulation)

| STPP | Merpol SE | Merpol SH | Merpol LFH | Merpol HCS | Fluoro-Surfactant** | Fluoro-Chemical*** | Resoiling Performance (ΔE) |
|---|---|---|---|---|---|---|---|
| ------ NONE----------* | | | | | | | 8.4 |
| 0 | 5 | 0 | 0 | 0 | 0 | 0 | 7.1 |
| 10 | 0 | 10 | 0 | 0 | 0 | 0 | 7.1 |
| 10 | 0 | 0 | 10 | 0 | 0 | 0 | 8.7 |
| 10 | 0 | 0 | 0 | 7.7 | 0 | 0 | 9.9 |
| 10 | 0 | 5 | 0 | 0 | 5 | 0 | 6.9 |
| 10 | 0 | 9.5 | 0 | 0 | 5 | 246 | 4.0 |
| 0 | 0 | 10.5 | 0 | 0 | 5 | 0 | 7.3 |

*This control carpet was not washed; rather, it was tested in its original clean condition.
**Fluorosurfactant is "Zonyl" 7950
***Fluorochemical is "Zonyl" 5180

The carpet used for measuring the resoiling performance was a new, clean nylon 6,6 carpet composed of nylon 6,6 fibers having voids in their cross-sections as described in U.S. Pat. No. 3,745,061. The carpet was topically treated with a fluorochemical soil-resist agent by the carpet manufacturer. The new carpet was washed with the specified cleaning formulation, dried at room temperature, and then tested for resoiling performance per the drum method described under the above Test Methods. In the above Table III, a lower ΔE value means the carpet resisted resoiling better than a carpet with a higher ΔE value. While each of the cleaning formulations which contain STPP along with "Merpol" SE, "Merpol" SH, or "Merpol" HCS provide good cleaning efficiency (see Table II), those cleaning formulations which contain STPP, "Merpol" SH, fluorosurfactant, and fluorochemical provide the carpet with the best resoiling performance as shown in above Table III.

EXAMPLE 2

This example illustrates the superior cleaning efficiency properties of the cleaning formulations of this invention. These formulations are shown in Table IV below. The Cleaning Efficiency of the different formulations was measured on a soiled nylon 6 carpet composed of nylon 6 fibers having voids in their cross-sections as described in U.S. Pat. No. 3,745,061 per the Test Methods described above.

TABLE IV

CLEANING FORMULATIONS
(Concentration In Grams of Ingredient Per Gallon of Cleaning Formulation)

| Formulation No. | Builder A | Nonionic Surfactant | Fluoro-Surfactant | Fluoro-Chemical | Stain Resist |
|---|---|---|---|---|---|
| Control 5* | | | | | |
| Control 12* | | | | | |
| T-17B** | 10 | 10 | 1 | 0 | 0 |
| T-18A** | 10 | 10 | 2 | 250 | 0 |
| T-19** | 15 | 15 | 5 | 245 | 250 |

*The composition of commercially available controls 5 and 12 is unknown.
**Builder A is sodium tripolyphosphate
Nonionic surfactant is "Merpol" SH
Flourosurfactant is "Zonyl" 7950

TABLE IV-continued

CLEANING FORMULATIONS
(Concentration In Grams of Ingredient Per Gallon of Cleaning Formulation)

| Formulation No. | Builder A | Nonionic Surfactant | Fluoro-Surfactant | Fluoro-Chemical | Stain Resist |
|---|---|---|---|---|---|

Fluorochemical is "Zonyl" 5180
Stain resist is "Zelan" 338

TABLE V

CLEANING EFFICIENCY
(Percent Change Δ E Measured For 0 To 5 Wand Passes)

| CLEANING FORMULATION | NO. OF WAND PASSES 0 | 1 | 3 | 5 |
|---|---|---|---|---|
| Control 5 | 0% | −9% | 30% | 47% |
| Control 12 | 0% | −3% | 35% | 48% |
| T-17B | 0 | 35% | 62% | 70% |
| T-18A | 0 | 9% | 42% | 53% |
| T-19 | 0 | 26% | 53% | 60% |

Clearly, the formulations of this invention (T-17B, T-18A, T-19) have a faster cleaning rate (percent change in ΔE after 1 wand pass) and a better cleaning ceiling (percent change in ΔE after 5 wand passes) than that of the best commercially available cleaners tested (Controls 5 and 12).

TABLE VI

| RESOILING PERFORMANCE | |
|---|---|
| CLEANING FORMULATION | Δ E |
| None* | 14.3 |
| T-17B | 13.1 |
| T-18A | 11.9 |
| T-19 | 9.7 |

The carpet used for measuring the resoiling performance was a new, clean nylon 6,6 carpet composed of nylon 6,6 fibers having voids in their cross-sections as described in U.S. Pat. No. 3,745,061. The carpet was not topically treated with a fluorochemical soil-resist agent by the carpet manufacturer. The new carpet was washed with the specified cleaning formulation, dried at room temperature, and then tested for resoiling performance per the drum method described under the above Test Methods. In the above Table VI, a lower ΔE value means the carpet resisted resoiling better than a carpet with a higher ΔE value. Since cleaning formulation T-17B contained fluorosurfactant, less soil stuck to the carpet which was cleaned with the T-17B formulation versus the new carpet which was not cleaned with any formulation. Cleaning formulation T-18A was similar to T-17B except that it also contained a fluorochemical soil resist ("Zonyl" 5180). Thus, T-18A had better resoiling properties than T-17B. Lastly, formulation T-19 also contained a stain resist ("Zelan" 338) and it had still better resoiling properties than T-17B and T-18A.

* This control carpet was not washed; rather, it was tested in its original clean condition.

EXAMPLE 3

This example illustrates that the cleaning formulations of this invention work well on all types of carpet, regardless of carpet face fiber type, fiber cross-section and with or without pretreatment of the carpet with a fluorochemical prior to soiling. In most instances, the formulations of this invention (T-17B and T-18A) have a better cleaning rate (percent change in ΔE after one wand pass) and better cleaning ceiling (percent change in ΔE after 5 wand passes) than the commercially available cleaning formulation, Control 5.

TABLE VII

CLEANING EFFICIENCY
(Percent Change in ΔE Measured for 0 to 5 Wand Passes)

| | | No. of Wand Passes | | | |
|---|---|---|---|---|---|
| FORMULATION | CARPET TYPE | 0 | 1 | 3 | 5 |
| Control 5 | Nylon 6 trilobal | 0% | −9% | 30% | 47% |
| | Nylon 6,6 trilobal | 0% | 17% | 49% | 60% |
| | Nylon 6 trilobal & FC* | 0% | −3% | 36% | 51% |
| | Nylon 6,6 trilobal & FC* | 0% | 19% | 53% | 62% |
| | Nylon 6,6 Legacy** | 0% | 14% | 51% | 69% |
| T-17B | Nylon 6 trilobal | 0% | 35% | 62% | 70% |
| | Nylon 6,6 trilobal | 0% | 32% | 57% | 65% |
| | Nylon 6 trilobal & FC | 0% | 47% | 72% | 76% |
| | Nylon 6,6 trilobal & FC | 0% | 50% | 70% | 76% |
| | Nylon 6,6 Legacy | 0% | 32% | 62% | 73% |
| T-18A | Nylon 6 trilobal | 0% | 9% | 42% | 53% |
| | Nylon 6,6 trilobal | 0% | 30% | 49% | 59% |

TABLE VII-continued

CLEANING EFFICIENCY
(Percent Change in ΔE Measured for 0 to 5 Wand Passes)

| | | No. of Wand Passes | | | |
|---|---|---|---|---|---|
| FORMULATION | CARPET TYPE | 0 | 1 | 3 | 5 |
| | Nylon 6 trilobal & FC | 0% | 43% | 63% | 68% |
| | Nylon 6,6 tritobal & FC | 0% | 28% | 49% | 60% |
| | Nylon 6,6 Legacy | 0% | 30% | 56% | 72% |

*FC - treated with fluorochemical by carpet manufacturer.
**Legacy is carpet made from DuPont "Antron" Legacy nylon 6,6 fibers.

I claim:

1. An aqueous cleaning formulation comprising:

(a) 0.1 to 50 grams of an inorganic or organic builder per gallon of cleaning formulation, (b) 0.1 to 100 grams of a mixed alkyl ethoxylate ($C_{10}$–$C_{16}$) nonionic surfactant, with a hydrophile-lipophile balance value in the range of 10.5 to 15, per gallon of cleaning formulation, and (c) 0.1 to 100 grams of a fluorosurfactant per gallon of cleaning formulation, the cleaning formulation being essentially free of organic solvents.

2. The aqueous cleaning formulation of claim 1, further comprising 1.0 to 500 grams of soil-resist agent per gallon of cleaning formulation.

3. The aqueous cleaning formulation of claim 2, wherein the soil-resist agent is a polymeric fluorochemical.

4. The aqueous cleaning formulation of claim 1, further comprising 1.0 to 500 grams of stain-resist agent per gallon of cleaning formulation.

5. The aqueous cleaning formulation of claim 4, wherein the stain-resist agent is selected from the group consisting of a polymer of hydrolyzed maleic anhydride with an aliphatic alpha olefin, an aromatic olefin, or vinyl ether and a polymer of methacrylic acid.

6. The aqueous cleaning formulation of claim 1, further comprising a polymeric fluorochemical soil-resist agent and a stain-resist agent.

7. The aqueous cleaning formulation of claim 1, wherein the builder is an inorganic builder selected from the group consisting of sodium tripolyphosphate, sodium sesquicarbonate and mixtures thereof.

8. The aqueous cleaning formulation of claim 7, wherein the concentration of sodium tripolyphosphate is about 1 to 30 grams/gallon of the formulation, the concentration of mixed alkyl ethoxylate nonionic surfactant is about 1 to 30 grams/gallon of the formulation, and the concentration of fluorosurfactant is about 1 to 20 grams/gallon of the formulation.

9. The aqueous cleaning formulation of claim 1, wherein the builder is an organic builder.

10. The aqueous cleaning formulation of claim 1, wherein the fluorosurfactant comprises a mixture of the compounds of Formula I and Formula II:

$$F(CF_2)_n—CH_2CH_2—S—CH_2CH_2—COOLi \quad \text{I}$$

-continued

II

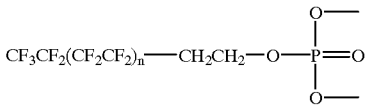

11. The aqueous cleaning formulation of claim 1, wherein the inorganic builder is sodium tripolyphosphate, the mixed alkyl ethoxylate ($C_{10}$–$C_{16}$) nonionic surfactant has a hydrophile-lipophile balance value of 12.8, and the fluorosurfactant comprises a mixture of the compounds of Formula I and Formula II:

I

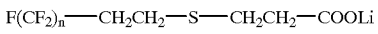

II

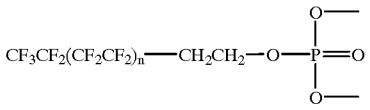

12. A cleaning concentrate suitable for making an aqueous cleaning formulation, comprising:

(a) an inorganic or organic builder, (b) a mixed alkyl ethoxylate ($C_{10}$–$C_{16}$) nonionic surfactant with a hydrophile-lipophile balance value in the range of 10.5 to 15, and (c) a fluorosurfactant, whereby the concentrate is capable of being diluted with an appropriate amount of water to produce an aqueous cleaning formulation having a concentration of 0.1 to 50 grams of inorganic or organic builder per gallon of cleaning formulation, 0.1 to 100 grams of mixed alkyl ethoxylate ($C_{10}$–$C_{16}$) nonionic surfactant, with a hydrophile-lipophile balance value in the range of 10.5 to 15, per gallon of cleaning formulation, and 0.1 to 100 grams of fluorosurfactant per gallon of cleaning formulation, the cleaning concentrate being essentially free of organic solvents.

13. The cleaning concentrate of claim 12, further comprising a soil-resist agent, whereby the concentrate is capable of being diluted with an appropriate amount of water to produce an aqueous cleaning formulation having a concentration of 0.1 to 50 grams of inorganic or organic builder per gallon of cleaning formulation, 0.1 to 100 grams of mixed alkyl ethoxylate ($C_{10}$–$C_{16}$) nonionic surfactant, with a hydrophile-lipophile balance value in the range of 10.5 to 15, per gallon of cleaning formulation, 0.1 to 100 grams of fluorosurfactant per gallon of cleaning formulation, and 0.1 to 500 grams of soil-resist agent per gallon of cleaning formulation.

14. The cleaning concentrate of claim 12, further comprising a stain-resist agent, whereby the concentrate is capable of being diluted with an appropriate amount of water to produce an aqueous cleaning formulation having a concentration of 0.1 to 50 grams of inorganic or organic builder per gallon of cleaning formulation, 0.1 to 100 grams of mixed alkyl ethoxylate ($C_{10}$–$C_{16}$) nonionic surfactant, with a hydrophile-lipophile balance value in the range of 10.5 to 15, per gallon of cleaning formulation, 0.1 to 100 grams of fluorosurfactant per gallon of cleaning formulation, and 0.1 to 500 grams of stain-resist agent per gallon of cleaning formulation.

15. The cleaning concentrate of claim 12, further comprising a soil-resist and stain-resist agent, whereby the concentrate is capable of being diluted with an appropriate amount of water to produce an aqueous cleaning formulation having a concentration of 0.1 to 50 grams of inorganic or organic builder per gallon of cleaning formulation, 0.1 to 100 grams of mixed alkyl ethoxylate ($C_{10}$–$C_{16}$) nonionic surfactant, with a hydrophile-lipophile balance value in the range of 10.5 to 15, per gallon of cleaning formulation, and 0.1 to 100 grams of fluorosurfactant per gallon of cleaning formulation, 0.1 to 500 grams of soil-resist agent per gallon of cleaning formulation, and 0.1 to 500 grams of stain-resist agent per gallon of cleaning formulation.

16. A method of using the aqueous cleaning formulation of claim 1 to clean a textile fabric having soil on its surface comprising the steps of spraying the formulation having a temperature in the range of room temperature to 160° F. onto the surface of the textile fabric such that at least some of the soil on the surface is loosened; and removing the loosened soil.

17. The method of claim 16, wherein the loosened soil is removed by a vacuuming means.

18. The method of claim 16, wherein the textile fabric is a carpet.

* * * * *